United States Patent [19]

Romanik et al.

[11] 4,152,963

[45] May 8, 1979

[54] HAND SLICER FOR PREPARED MEATS

[76] Inventors: Lawrence J. Romanik, 9 Nadine Pl. S.; Robert W. Jones, 979 Bruce Ct., both of Westerville, Ohio 43081

[21] Appl. No.: 795,330

[22] Filed: May 9, 1977

[51] Int. Cl.[2] ..... B26D 1/10; B26D 4/50

[52] U.S. Cl. ..... 83/762; 83/165; 83/437

[58] Field of Search ..... 83/762, 437, 157, 112, 83/165

[56] References Cited

U.S. PATENT DOCUMENTS

| | | | |
|---|---|---|---|
| 805,482 | 11/1905 | McCroskey | 83/437 |
| 1,918,675 | 7/1933 | Webster | 83/762 |
| 2,036,403 | 4/1936 | Friesel | 83/437 |
| 2,311,618 | 2/1943 | Coleman | 83/157 |
| 2,855,965 | 10/1958 | Vidovic | 83/157 |
| 3,971,273 | 7/1976 | Peters | 83/762 X |

*Primary Examiner*—Willie G. Abercrombie
*Attorney, Agent, or Firm*—Anthony D. Cennamo

[57] ABSTRACT

A hand slicer for prepared meat such as roasts, hams, and other boneless meats. The meat is positioned in a rack that has a configuration closely approximating that of the prepared meat to prevent back and forth movement as well as eliminating the use of a hand to hold the meat. The meat is advanced by a screw mechanism to a stop plate which in turn is a predetermined cutting position to control the portions of the cut. The stop also serves as a plate for receiving the cut slices and for dispensing the cut portion to another plate. The rack has an elongated slot positioned over a tray for the saving of the meat juices. A warming oven encloses the entire slicer to maintain the meat at a predetermined temperature.

11 Claims, 8 Drawing Figures

31
37
33
35
75
39

32
44
42
52
19
10

85
71
66
30
65
60
67
61
34a
43
34

FIG. 1A
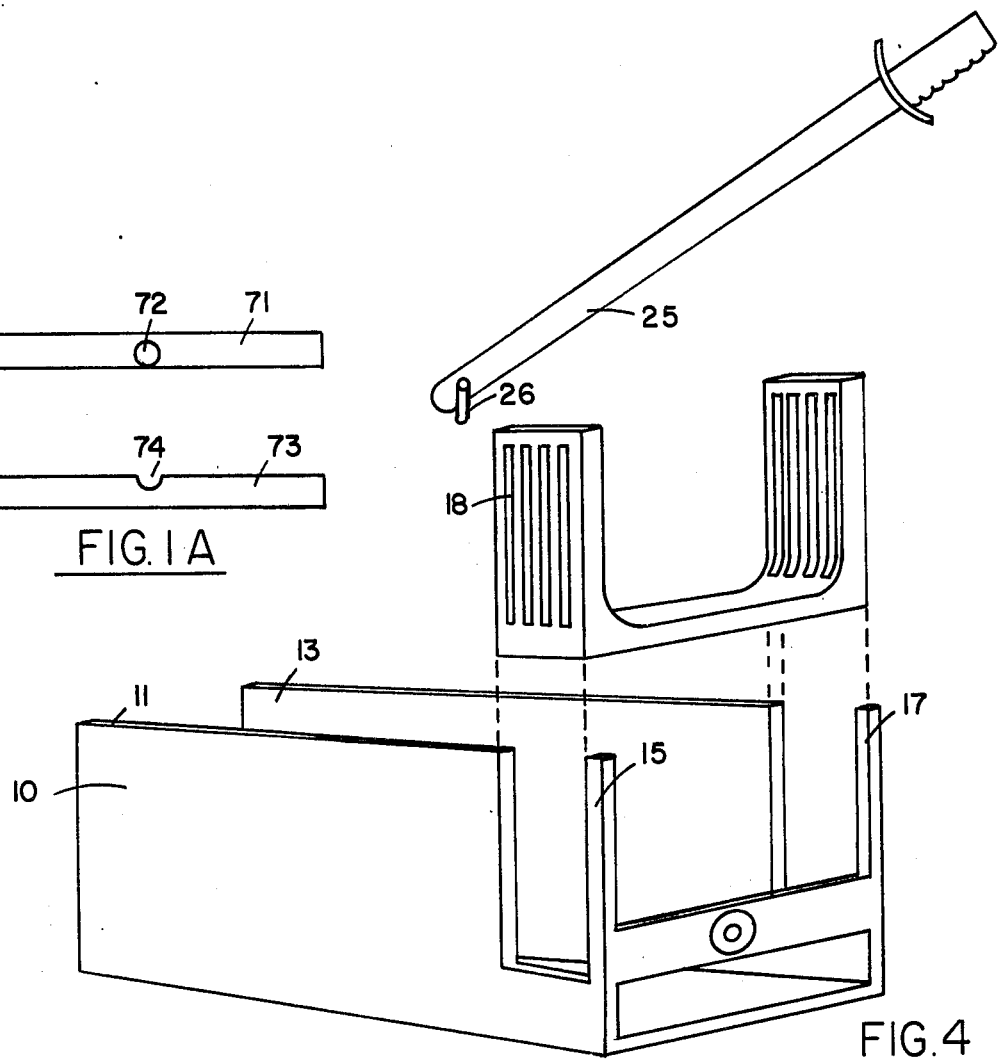
FIG. 4
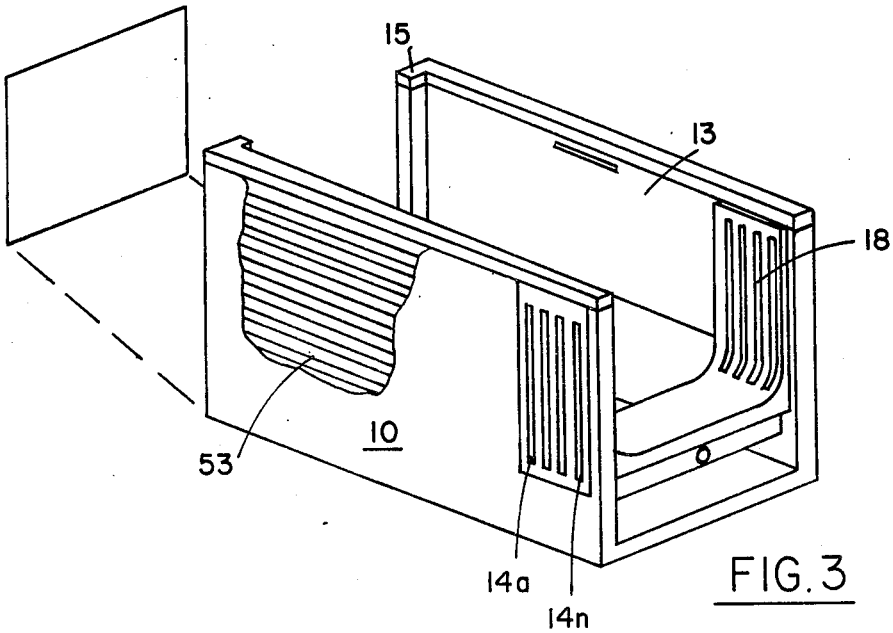
FIG. 3

HAND SLICER FOR PREPARED MEATS

BACKGROUND

The restaurants serving food to the greatest number of persons are those termed as the fast foods. These restaurants have more or less been limited to those foods having relatively simple portion control i.e. hamburger per weight, chicken per pieces, weiner per unit, and beef and ham in chipped portions to be individually weighed. Other fast food restaurants serving the prepared meal cut the meat portion before cooking. This, too, does not present a particular portion control problem.

In view of the extremely large number of portions dispensed daily by the fast food restaurants, accuracy in portion is most essential to cost control. This is especially true with the meat items in prepared dinners in that they represent the highest cost factor.

Prime ribs (generically known although not necessarily of U.S. prime quality) is a favored dish in most sit-down and serve restaurants. Due to the cooking losses, the varying and odd shapes of the overall roasts, together with the in-bone, the prime rib is not extensively sold in fast food restaurants. More recently there has been localized sucess in selling prime rib prepared meals in the fast food restaurants.

Although there is available to the restaurants commercially pre-prepared boneless prime rib for cooking, the attendant disadvantages of handling and portion control have not been resolved. Initially, prime rib restaurant meals are sold in a medium-rare cooked state; the roast when cutting is, therefore, very pliable. When this is taken into consideration together with the young and inexperienced kitchen help generally employed by the fast food restaurants, portion cutting with any degree of accuracy is not attained. The minimum markup on the per meal served together with the large turnover in help almost precludes the sale of prime rib dinners in a fast food restaurant. A prepared prime rib portion cut to meet a certain meal price level, for instance, needs to have 26 slices per roast. If only 25 slices are attained the entire profit for the roast is lost; on the other hand, 27 slices would be underselling to the customer.

Again, there are other problems of fast-food prime rib beef; particularly, most states have ordinances requiring that the beef be retained at all times at a pre-determined temperature. These temperatures can only be attained in an oven. Realistically, then the prime rib especially if it were sold in a fast food restaurant, would be continually placed in and removed from an oven. The personnel handling the meat is multiplied and practically speaking would defeat any sanitation regulations.

There is in the prior art innumerable portion slicers, particularly with bread and bacon, but there are some for meat and a few for cooked foods such as beef. These, too, have their attendant disadvantages and hence do not resolve the problems found in dispensing prime beef or the like in a fast food restaurant.

With the known prior art beef slicers it is still necessary that the human hand maintain the position of pliable meat. Accordingly, in a fast food restaurant with the large number of working personnel it is not inconceivable that 5–10 different hands would be holding each piece of beef when cutting and/or when returning the beef to the oven.

Under exertion of the hand on the meat defeats any attempt at accuracy as the greasy meat will move back and forth; over exertion of the hand on the meat causes loss of juices. The most important aspect of prime ribs is its juices—a jus. Loss of juices therefore is not only a loss of weight but also results in a dryer piece of meat—less appealing and desireable.

As aforesaid, the prior art has not suggested a reasonable solution at maintaining the meat at a predetermined temperature. Placing the entire cutter in and out of the oven is of questionable benefit, increases handling, and merely aggravates the aforesaid problems. In actuality the help would probably allow the cutter to set on a counter irrespective of rules, regulations, and laws.

So-called hot plates are known but these plates are either too hot, which would result in the further cooking of the underside of the roast, or not hot enough to maintain the entire roast at any great temperature.

SUMMARY OF INVENTION

The present invention overcomes the above-noted attendant disadvantages of the prior art cutting apparatus for portion control of prepared meats and particularly not fully cooked meats, such as prime rib. The cutting apparatus in a preferred embodiment completely eliminates the need for touching of the beef roast anytime before or after cutting. Most significantly, the roast beef is maintained in an enclosing oven at the necessary predetermined temperature for sanitation and customer appeal purposes. The apparatus comprises a base structure having a rack positioned thereon of a size sufficient to accomodate the entire roast. The rack generally is of a configuration to accomodate the varying sizes of the roast and in a second embodiment has a top plate so configured to firmly hold the roast. The rack also has provision for the collection of the lossed juices in a lower positioned container. The knife is utilized in and retained in position in knife guides by a stop mechanism thereon. The meat in the rack is moved longitudinally by a threaded mechanism having a push plate thereon. The control of the depth of movement is by a stop plate positioned at the extreme end of the cutter. The distance of the knife guide position from the stop plate is in accordance with the portion to be cut. After the meat is cut the end plate is hingedly dropped cut portion of meat is directed onto a plate.

The entire assembly is such that most sharp corners and crevices that may retain bits of meat or meat juices are reduced to a minimum. Further because of frequent use the assembly is lightweight, and relatively small; and also may be dissassembled into component parts to be placed in a washing machine for cleaning and sterilizing after each use.

To maintain the roast at a pre-determined temperature the preferred embodiment comprises an enclosing oven. The oven includes a thermostat control for temperature adjustment. The oven in essence is the base structure and is not in contact with the beef nor that part of the cutter wherein there may be meat juice transfer. Accordingly the oven need not be washed as often as the cutter assembly.

OBJECTS

It is a principal object of the present invention to provide an improved portion cutter for prepared boneless meat such as prime ribs that is accurately controlled and completely eliminates the need of hands touching the meat.

Another object of the invention is to provide such a cutter that includes apparatus that is operative to maintain in position varying sizes and shapes of meat.

Another object of the invention is to provide such a cutter that includes means for the collection of the normally lossed meat juices.

A further object of the invention is to provide such a cutter that is simple in construction, readily portable, and washable in a washing machine.

Still another object of the present invention is to provide a cooked meat cutter that is at all times in a temperature controlled oven.

Other objects and features of its present invention will become apparent from the following detailed description when taken in conjunction with the drawings in which:

BRIEF DESCRIPTION OF DRAWINGS

FIG. 1A illustrates support means for the meat positioning mechanism.

FIG. 3 is an end view of the cutter showing the positioned knife guides.

FIG. 4 is another view of the cutter illustrated schematically with the knife guides.

FIG. 6 illustrates the end plate stop and sliced meat tray.

DETAILED DESCRIPTION OF DRAWINGS

Figures 1, 2, 5:
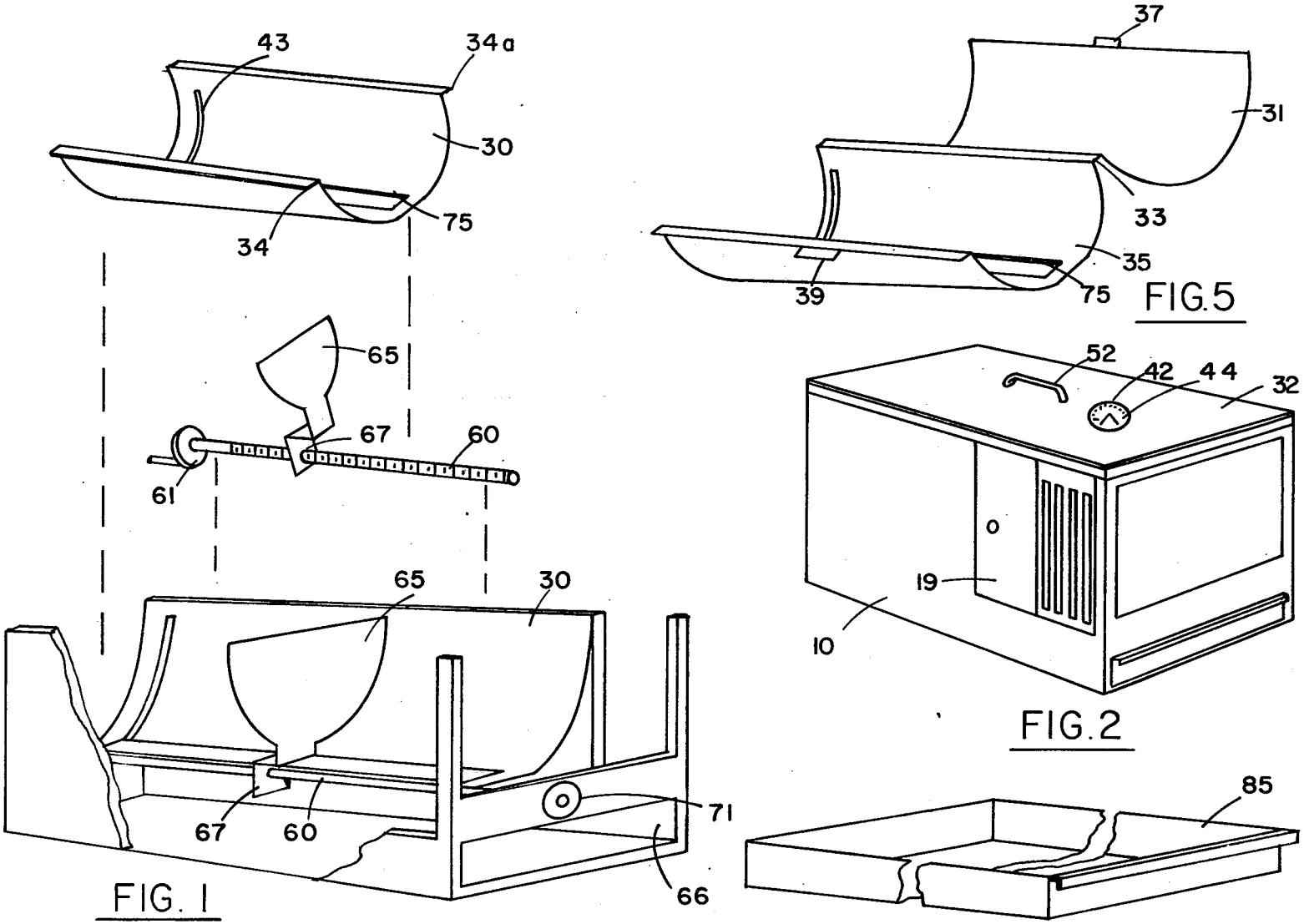
FIG. 1 is an overall view in perspective of the complete embodiment of the present invention with the cover for the oven and a partial wall removed.
FIG. 2 is an overall view in perspective of the complete embodiment of the present invention in its use.
FIG. 5 illustrates in perspective another supporting rack for the prepared meat.

With reference to the drawing figures and particularly to FIG. 1, there is illustrated schematically the principles of the present invention in a preferred embodiment.

There is positioned on the structure base 10 the rack 30 the support for the meat. Flanges 34*a* and 34*b* rest on the uppermost portion of the base 10. The rack 30, as illustrated schematically in perspective in FIG. 1 comprises the workpiece rack 30 having a crossectional horizontal configuration that is very generally semi-circular. Structurally the rack 30 provides a cradle-like support for the prepared meat.

In the embodiment of FIG. 1 the rack 30 does not have a top support for the workpiece; however, depending on the product being sliced, a top support as shown in FIG. 5 may be more fully operative. The top portion 31 is hingedly supported at 33 to the low half 35. Additionally, and again depending on the product being sliced, the lower half of rack configuration in the embodiment of FIG. 5 is relatively flat on the bottom and more pronouncedly curved upward at its sides. The configuration of the lower part 30 is intended to approximate the bottom half of a cooked prime rib roast. The top half 31 of rack 30 has an overall configuration approximately the top half of a prepared prime rib; that is, curved at its hinge side and more or less straight with a slight curvature thereafter. The two rack halves 35 and 31 when closed by clasps 37 and 39 are intended to hold the cooked beef in its natural shaped position.

Through the lowermost portion of the rack 30 there is an elongated perforation 75 intended to allow the natural juices to flow therethrough to the tray 85 positioned in the base of the structure 10 by the drawer support 66.

With continued reference to FIG. 1 there is illustrated the meat positioning mechanism relative to the cutter guides for the portion control features of the present invention. Fixedly positioned on the top of the base 10 is threaded bar 60. Positioning of the bar 60 is defined by the supporting walls 71 and 73 of the rack 30 of FIG. 1A. End wall 71 has an aperture therein to receive the end of the bar 60 whereas the back wall 73 has a u-shaped support for the handle end of the bar 60. Riding horizontally on threaded bar 60 is push plate 65. As can be seen from FIG. 1 the threaded nut support 67 for plate 65 rides down the center of the aforementioned channel 75 in the bottom of rack 30. Rotation of the threaded bar 60 by turning handle 61 causes the support nut 67, and hence plate 65, to advance forwardly in ½ inch increments. In operation, the action of the threaded bar 60 and plate 65 pushes the meat horizontally through the rack support 30 along the aforesaid elongated perforation 75. At the cutting end of the structure stop plate 12 rigidly support in stancheon 16, as described hereinafter relative to FIG. 6, stops the advancement of the meat horizontally to a cutting position i.e., relative to the cutter guides 18.

With particular reference now to FIGS. 3 and 4 there is illustrated schematically the knife guides 18 of the cutter of the present invention. The knife guides 18 is a single piece insert to be positioned between walls 11 and 13 and stancheons 15 and 17. Various means may be employed to sealing engage the knife guides 18 with its supports. In this embodiment overlapping edges were employed. Equally as well a tongue and groove arrangement may have been utilized.

When in place, the bottom portion surface of knife guides 18 exactly registers horizontally with that of the rack 30. In this way the meat readily slides from one to the other.

As shown, knife guides 18 has a series of slots 14*a* x x x 14*n* depending on the utilization of the cutter. In slicing roast beef it was found that four slots provide a sufficient variation in the control of the portion to be cut.

The knife guide slots 14 are as narrow as permitted by the conventional straight-sided carving knife. As the meat is advanced and stopped by stop plate 12 the thickness of the portion is determined. The cutter guides 18 having fixed spacing therebetween will cause the knife 25 to cut, each time, exactly the same thickness portion.

Figure 6A:
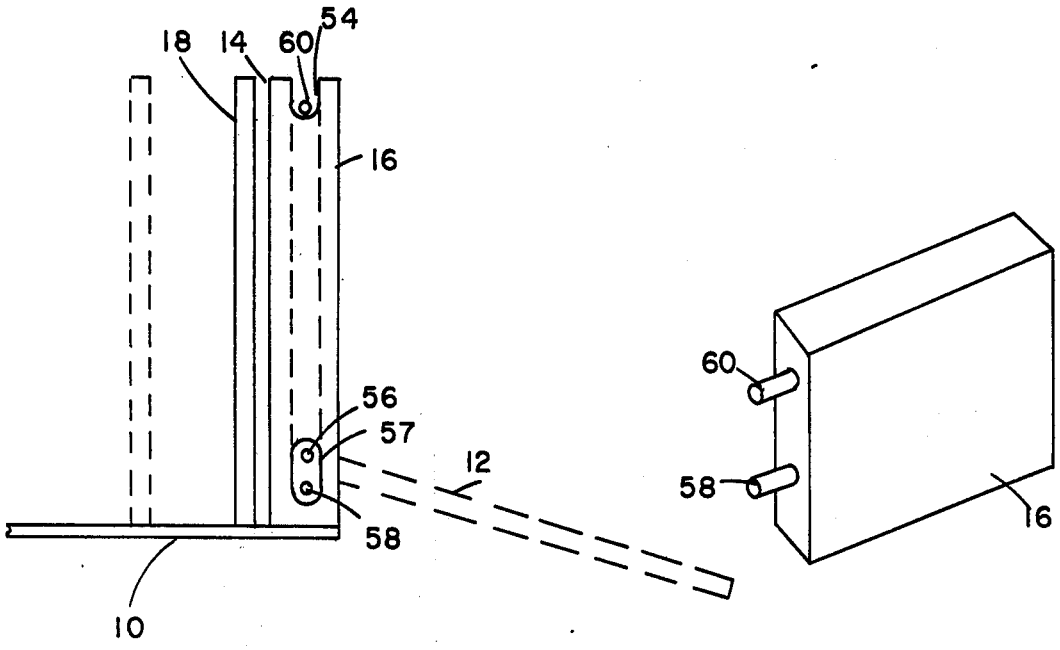
FIG. 6A illustrates the end plate.

The end plate 12 is illustrated in more detail in FIGS. 6 and 6A. Positioned on both ends of plate 12 are pins 58 and 60 protruding therefrom. The distance between pins 58 and 60 is exactly the same as the distance between the bottoms of slots 54 and 56 in the stancheon 16 and as shown in FIG. 6 (other side not shown). The upper slot 54 is an open-ended slot whereas the lower slot 56 is a closed-ended slot. Slot 56 is much longer than slot 54. It is apparent that when pins 58 and 60 rest in slots 54 and 56 the plate 12 is fixed and are operative as a stop plate as aforesaid. The close fitting between the edges of the plate 65 and the walls of the rack precludes movement in a cross direction. By lifting plate 12 vertically, by knob 20 the upper pin 60 is raised, and hence freed from slot 54; whereas pin 58 is retained in slot 56. Pin 58 and slot 56 in this way is a hinge for pivotally permitting the plate 12 to drop. As shown in FIG. 6 the upper end of plate 12 drops below the lowermost portion of the overall structure. This permits the slice of meat once severed and resting on stop plate 12 to be removed therefrom onto a dish.

In the event that it is desired that the end plate (door) be removed such as for periodic washing, the slot 56 may comprise cross-open slot 57. In this event the slot 56 should be substantially longer than slot 54 to prevent the door falling out when it is opened. The cross slot 57 would be positioned in the upper portion of slot 56.

The knife 25 may be conventional and it has been found that straight sided carving knives are particularly adaptable. It is understood an electrical reciprocating knife, also commercially available, may be utilized in a production unit of the present invention. In a preferred embodiment, however, the knife 25 was considerably longer than the standard length, the hand guard was especially large for hand protection, and at its extreme end a stop 26 was positioned therein. In that the entire cutter is intended for use by inexperienced help all precautions were taken to assure their safety. With the long knife there is a sufficient stroke for cutting but yet the stop 26 assures the knife will not come out from its slots.

With continued reference to the drawings, the oven of the preferred embodiment may now be described. Most if not all states have ordinances or regulations requiring restaurants to maintain cooked meat at a predetermined temperature for contamination purposes. Also, meat, particularly roast beef, is less palatable when its temperature drops below a certain temperature. Accordingly, it is necessary and desired that the beef at all times be kept at a prescribed temperature.

Temperature control is accomplished in the present invention by providing a oven made from the entire structure as shown in FIGS. 2 and 3. The oven cover 32 (the top), both sides 11 and 13, bottom are heated walls to comprise the oven. Additionally, as shown the knife guides 18 together with sliding door 19, and the stop plate 12 completely encloses the structure. In this way the meat is not only in a controlled oven but is closed from contamination in the room. Also by means of the handle 52 the structure is held in place with one hand while the other hand of the operator cuts the meat.

With particular reference to FIG. 3 the walls of the oven comprise an electrical heating element 53 imbedded therein. By means of knob 44 the thermostat will vary the temperature of the oven. A scale 42 assists the temperature adjustment. There may be separate control for temperature adjustment and temperature readout.

With reference now to all of the Figures an overall appreciation of the merits of the preferred embodiment can be had.

The oven is not in any way in contact with the meat or meat juices and therefore need not be washed each time.

The oven 10—outside box structure is lined on its inside with porcelain metal, stainless steel, chromium, or other similar "wipe-clean" material. The rack 30 is lifted out from its rotation points 72 and 74 on end supports 71 and 73 with the push plate 65 passing through the slot 43 in the far end of the rack 30. The end plate 12 is swung open and lifted out. Accordingly, it can be seen that the components, rod 60, plate 65, rack 30, and door 16 together with pan 65 may be placed in a dishwashing type of machine for cleansing and sterilization. With the aforementioned parts removed and lid 32 lifted the inside of the oven/cutter is wiped clean.

In operation, the lid 32 is lifted and the push plate 65 is cranked back, the meat is placed into the rack 30, the door 16 is replaced, and the pan 85 is returned to its shelf and the lid is returned. To start the cutting procedure the meat is cranked until its far end touches the end plate 12. The knife is positioned in a slot 14 in the knife guides 18 and the oven is set at a predetermined temperature. In that the meat is prepacked before cooking the meat is transferred from the package to rack 30 without touching by hands. The entire cutting operation does not require the touch of a hand.

If the meat has varying diameters from end to end the slot 14 selected for cutting can be varied accordingly.

We claim:

1. A structure of unitized and interrelated components for slicing uniform portions of a precooked meat comprising:

a six-sided enclosure a rack having a semi-circular curvature, and means positioning said rack on the base of said enclosure, said rack related in configuration to the outside curvature of said meat, a push plate initially positioned at one end of said rack, a stop plate positioned at the opposite end of said rack, means for advancing said push plate longitudinally relative to said rack to advance the meat in said rack to said stop plate, a plurality of parallel knife guides comprising a U-shaped member and means positioning said member adjacent said stop plate to cross-sectional retain in position a knife, wherein the spacing between said guides is related to the predetermined slice thickness.

a pair of hinges for hingedly supporting said stop plate whereby when opened said stop plate receives the slice of meat for removal therefrom, and said six-sided enclosure including a hinged top for completely enclosing said structure.

2. The structure of claim 1 wherein said rack includes an elongated slot in the lowermost part of said curvature and a tray for receiving juices passing through said slot.

3. The structure in claim 1 wherein said means for advancing said push plate includes a threaded rod.

4. The structure for hand slicing of a precooked meat as set forth in claim 1 wherein said six-sided enclosure further comprises a heating element.

5. The enclosure of claim 4 further comprises thermostat means connected to said heating element for varying the temperature of said structure and to maintain the meat at a constant temperature.

6. The structure of claim 2 further comprising thread engaging means to interconnect said threaded rod with said push plate through said elongated slot.

7. The structure of claim 1 further wherein said rack, said push plate and said stop plate are separable interrelated components for dissassembly.

8. The structure in claim 1 wherein said hinges for said supporting stop plate comprises a pair of slots, one opened and one closed, and a pair of pins on said plate positioned in said slots.

9. The structure in claim 1 wherein said rack further comprises an upper part and a hinge for hingedly supporting said upper part with said lower part, and a locking means for maintaining said upper portion secured to said lower portion.

10. The structure of claim 9 wherein said upper part and said lower part are configured to substantially conform to the varying dimensions of precooked meat.

11. The structure of claim 1 wherein said knife further comprises a crossmember stop mechanism positioned adjacent the tip of the blade therof, and a hand guard intermediate the handle and blade.

* * * * *